US009649842B2

(12) United States Patent
Owaki et al.

(10) Patent No.: US 9,649,842 B2
(45) Date of Patent: May 16, 2017

(54) LIQUID EJECTING APPARATUS

(71) Applicant: SEIKO EPSON CORPORATION, Tokyo (JP)

(72) Inventors: Hiroshige Owaki, Okaya (JP); Mikio Kitagishi, Matsumoto (JP); Tomohiro Yuda, Minowa-machi (JP); Katsuhiro Okubo, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/222,957

(22) Filed: Mar. 24, 2014

(65) Prior Publication Data

US 2014/0285575 A1 Sep. 25, 2014

(30) Foreign Application Priority Data

Mar. 25, 2013 (JP) ..... 2013-061570

(51) Int. Cl.

| | |
|---|---|
| ***B41J 2/145*** | (2006.01) |
| ***B41J 2/21*** | (2006.01) |
| ***B41J 2/525*** | (2006.01) |
| ***B41J 2/175*** | (2006.01) |

(52) U.S. Cl.

CPC ..... *B41J 2/145* (2013.01); *B41J 2/17553* (2013.01); *B41J 2/21* (2013.01); *B41J 2/2103* (2013.01); *B41J 2/525* (2013.01)

(58) Field of Classification Search

CPC ... B41J 2/21; B41J 2/2103; B41J 2/525; B41J 2/14024; B41J 2202/20; B41J 2/145; B41J 2/17553

See application file for complete search history.

(56) References Cited

U.S. PATENT DOCUMENTS

| | | | | |
|---|---|---|---|---|
| 2002/0024554 | A1* | 2/2002 | Tominaga | 347/37 |
| 2004/0104965 | A1* | 6/2004 | Mitsuzawa | 347/43 |
| 2005/0206678 | A1* | 9/2005 | Nishino | 347/43 |
| 2006/0290725 | A1* | 12/2006 | Akahane | 347/9 |
| 2007/0097197 | A1* | 5/2007 | Kremers | B41J 2/2103 347/102 |

(Continued)

FOREIGN PATENT DOCUMENTS

| | | | |
|---|---|---|---|
| JP | H10-114087 | A | 5/1998 |
| JP | 2005-305959 | A | 11/2005 |

(Continued)

*Primary Examiner* — Justin Seo

(74) *Attorney, Agent, or Firm* — Maschoff Brennan

(57) ABSTRACT

A liquid ejecting apparatus includes a plurality of head units, in each of which a plurality of recording heads are disposed so as to be aligned in a main scanning direction in a holding member as a frame body, and a plurality of nozzle openings for discharging ink being disposed in a sub scanning direction in each recording head. The head units are aligned such that center lines thereof in the main scanning direction differ from each other in the main scanning direction. M (M is a natural number) liquid ejecting heads are attachable to each holding member in the main scanning direction. N (M>N (N is a natural number)) liquid ejecting heads, which discharge liquid, among the M liquid ejecting heads are arranged so as to be close to a center side of an entire width of the head units in the main scanning direction.

9 Claims, 4 Drawing Sheets

(56) References Cited

U.S. PATENT DOCUMENTS

| | | | | |
|---|---|---|---|---|
| 2013/0027487 | A1* | 1/2013 | Usuda | 347/102 |
| 2013/0335469 | A1* | 12/2013 | Saita | B41J 2/2103<br>347/12 |

FOREIGN PATENT DOCUMENTS

| | | | |
|---|---|---|---|
| JP | 2006-247911 | A | 9/2006 |
| JP | 2008-302577 | A | 12/2008 |
| JP | 2009-248501 | A | 10/2009 |

* cited by examiner

LIQUID EJECTING APPARATUS

BACKGROUND

1. Technical Field

The present invention relates to a liquid ejecting apparatus, and is particularly effectively applied to a liquid ejecting apparatus provided with a plurality of head units, in each of which a plurality of liquid ejecting heads for ejecting liquid are disposed in a holding member as a frame body.

2. Related Art

A liquid ejecting apparatus, representative examples of which include ink jet recording apparatuses such as an ink jet printer and a plotter, is provided with liquid ejecting heads capable of ejecting liquid such as ink retained in a cartridge, a tank, or the like as liquid droplets.

Among such a type of liquid ejecting apparatuses, there is a liquid ejecting apparatus provided with a plurality of head units, in each of which a plurality of liquid ejecting heads are disposed in a holding member as a frame body. In such a liquid ejecting apparatus, print throughput is affected by a disposing state of the liquid ejecting heads corresponding to the respective colors, and an ideal disposing state of the liquid ejecting heads differs depending on print content. Thus, there is a tendency that a dedicated apparatus is used for ideal arrangement for a specific use purpose.

JP-A-2006-247991 discloses a related art in which a plurality of head units with a plurality of liquid ejecting heads disposed therein are provided. In addition, JP-A-2009-248501 discloses, as a related art, a configuration in which two cartridges with nozzle arrays provided so as to deviate in a paper width direction are used so as to be attracted to the center.

However, the apparatuses disclosed in JP-A-2006-247991 and JP-A-2009-248501 are dedicated devices that do not have apparatus configurations, which realize an ideal disposing state of liquid ejecting heads depending on print content in consideration of print throughput and can be easily shared with other models.

Such problems are similarly present not only in ink-jet recording apparatuses but also in liquid ejecting apparatuses which eject liquid other than ink.

SUMMARY

An advantage of some aspects of the invention is to provide a liquid ejecting apparatus capable of easily realizing a reasonable disposing state of a plurality of liquid ejecting heads for satisfactorily maintaining throughput of printing or the like.

According to an aspect of the invention, there is provided a liquid ejecting apparatus including: a plurality of head units, in each of which a plurality of liquid ejecting heads are disposed so as to be aligned in a main scanning direction in a holding member as a frame body, and a plurality of nozzle openings for discharging liquid being disposed in a sub scanning direction in each of the liquid ejecting heads. The head units are aligned such that center lines thereof in the main scanning direction differ from each other in the main scanning direction. M (M is a natural number) liquid ejecting heads are attachable to the holding member of each head unit in the main scanning direction. N (M>N (N is a natural number)) liquid ejecting heads, which are made to discharge liquid, among the M liquid ejecting heads are arranged so as to be close to a center side of an entire width of the plurality of head units in the main scanning direction.

According to the aspect, it is possible to easily change the combination of the liquid ejecting heads to be disposed in the holding members and thereby not only to share components in multiple types of liquid ejecting apparatuses in accordance with use purposes but to arbitrarily realize appropriate arrangement in consideration of print throughput. That is, since the liquid ejecting heads which are made to discharge liquid droplets and perform actual printing or the like are arranged so as to be close to the center side of the entire width of the plurality of head units in the main scanning direction, it is possible to minimize the moving amounts of the plurality of integrally moving head units in the main scanning direction.

The liquid ejecting apparatus may further include a drive mode in which (M−N) liquid ejecting heads in each head unit are not made to eject the liquid. In addition, it is preferable that the head units be arranged in a staggered layout with a deviation in the sub scanning direction. In such a case, it is possible to easily achieve wide-band printing. In addition, the N head units may discharge liquid with colors including black. With such a configuration, it is possible to satisfactorily meet a requirement of multicolor printing or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a detailed description will be given of an embodiment of the invention with reference to drawings.

Figure 1:
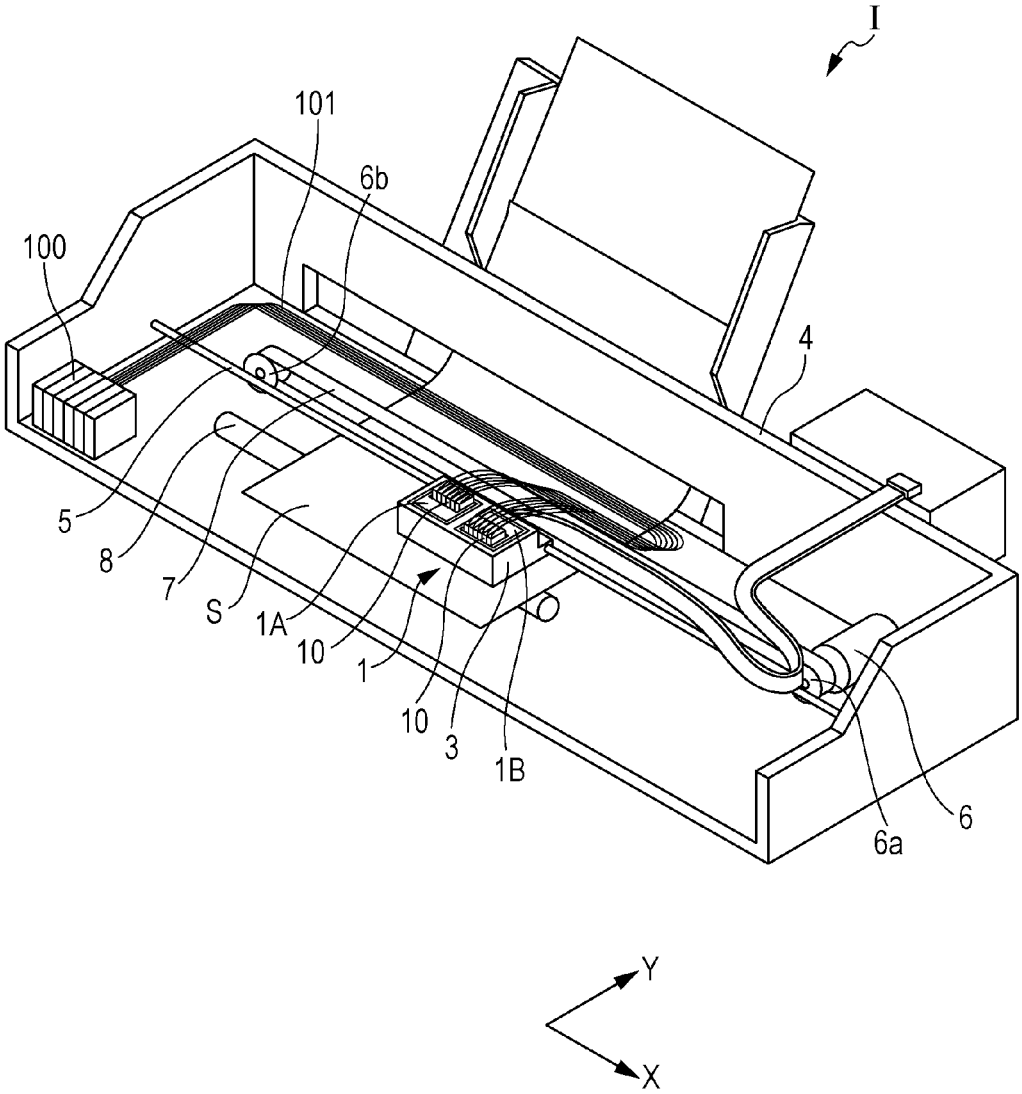
FIG. 1 is an outline perspective view of a recording apparatus according to a first embodiment of the invention.

FIG. 1 is an outline perspective view of an ink jet recording apparatus as an example of a liquid ejecting apparatus according to an embodiment of the invention. As shown in the drawing, an ink jet recording apparatus I as the liquid ejecting apparatus according to this embodiment is provided with a plurality of groups (two groups in the drawing) of head units 1A and 1B, each of which is configured of a plurality of ink jet recording heads (hereinafter, also referred to as recording heads). The head units 1A and 1B are mounted on a carriage 3. The carriage 3 with the head units 1A and 1B mounted thereon is provided at a carriage shaft 5 attached to an apparatus main body 4 such that the carriage 3 is movable in a shaft direction.

In addition, a drive motor 6 is provided in the vicinity of one end of the carriage shaft 5, and a first pulley 6*a* with a groove provided at an outer circumferential thereof is provided at a tip end of a shaft of the drive motor 6. Furthermore, a second pulley 6*b* corresponding to the first pulley 6*a* of the drive motor 6 is provided so as to be rotatable in the vicinity of the other end of the carriage shaft 5, and a ring-shaped timing belt 7 configured of an elastic member such as rubber is stretched over the first pulley 6*a* and the second pulley 6*b*.

In addition, a retaining section 100 configured of a tank in which ink is retained is provided in the apparatus main body 4, and the ink from the retaining section 100 is supplied to the respective recording heads 10 of the head units 1A and 1B mounted on the carriage 3 via a tube 101. The head units 1A and 1B of this embodiment are formed so as to be able to respectively discharge six types of ink, and a detailed description will be given later. Therefore, the retaining section 100 retains six types of ink at a maximum. The head units 1A and 1B according to this embodiment are configured to be able to selectively discharge one or more types of ink among six colors of ink, namely cyan (C), magenta (M), yellow (Y), black (B), light cyan (LC), and light magenta (LM).

Then, drive force of the drive motor 6 is delivered to the carriage 3 via the timing belt 7, and the carriage 3 with the head units 1A and 1B mounted thereon is thus moved in a main scanning direction X along the carriage shaft 5. In contrast, a platen 8 is provided in the apparatus main body 4 along the carriage 3. The platen 8 can be rotated by drive force of a paper feeding motor, which is not shown in the drawing, and a recording sheet S as an ejection target medium (recording medium) such as paper fed by a paper supply roller or the like is wound around the platen 8 and transported in a sub scanning direction Y.

According to such an ink jet recording apparatus I, the carriage 3 is moved in the main scanning direction X, ink droplets are discharged from the head units 1A and 1B, and the ink droplets land on the recording sheet S. For ejecting the ink droplets from the head units 1A and 1B, there is a method in which the discharge is performed only when the carriage 3 is moved in one direction, and there is also a method in which the ejection is performed when the carriage 3 is moved in both directions, namely during a round trip. In addition, it is possible to realize high-speed printing by causing the head units 1 to discharge the ink droplets when the carriage 3 moves in both the directions.

Figure 4:
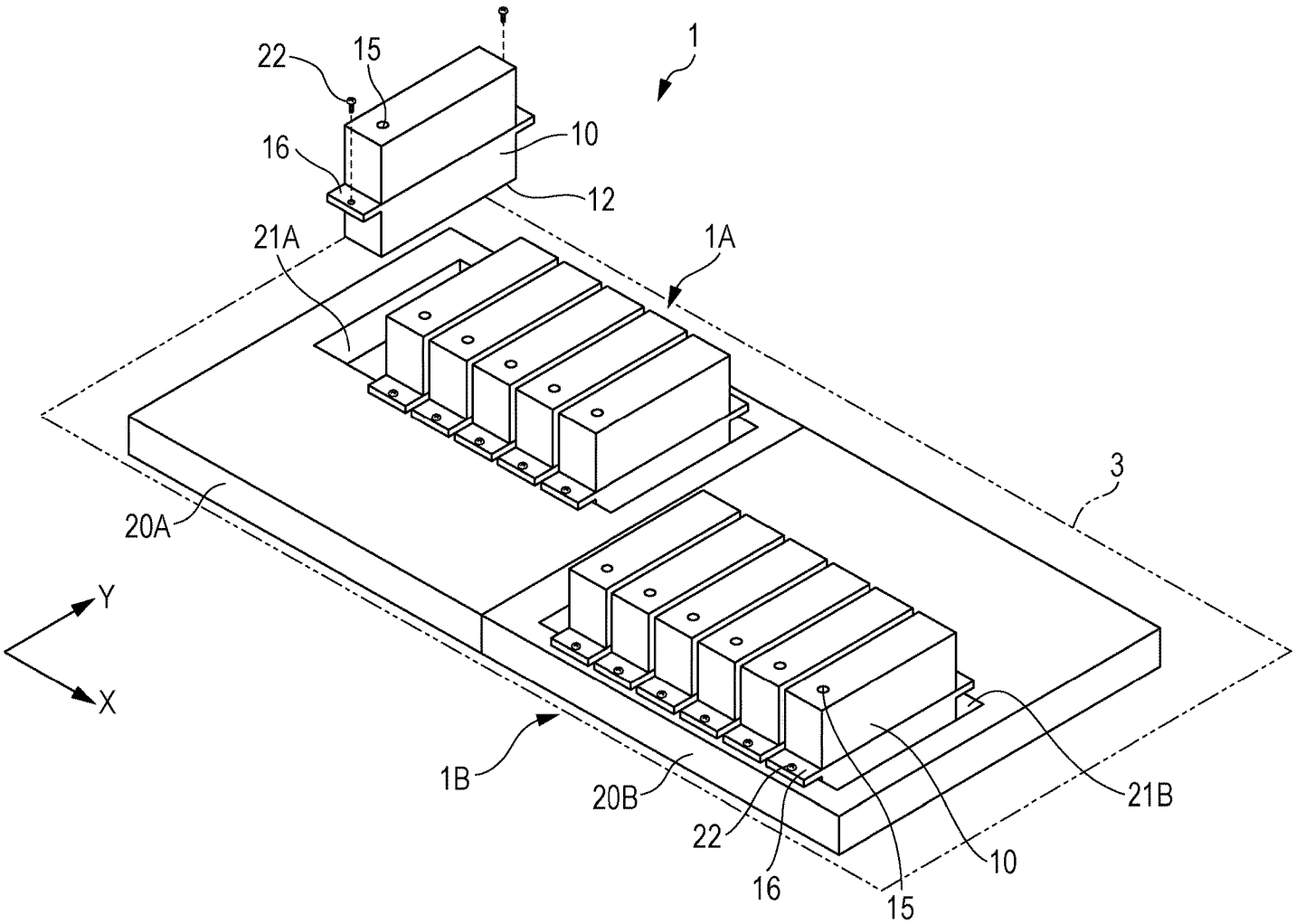
FIG. 4 is an outline perspective view of head units according to the first embodiment of the invention.
Figure 5:
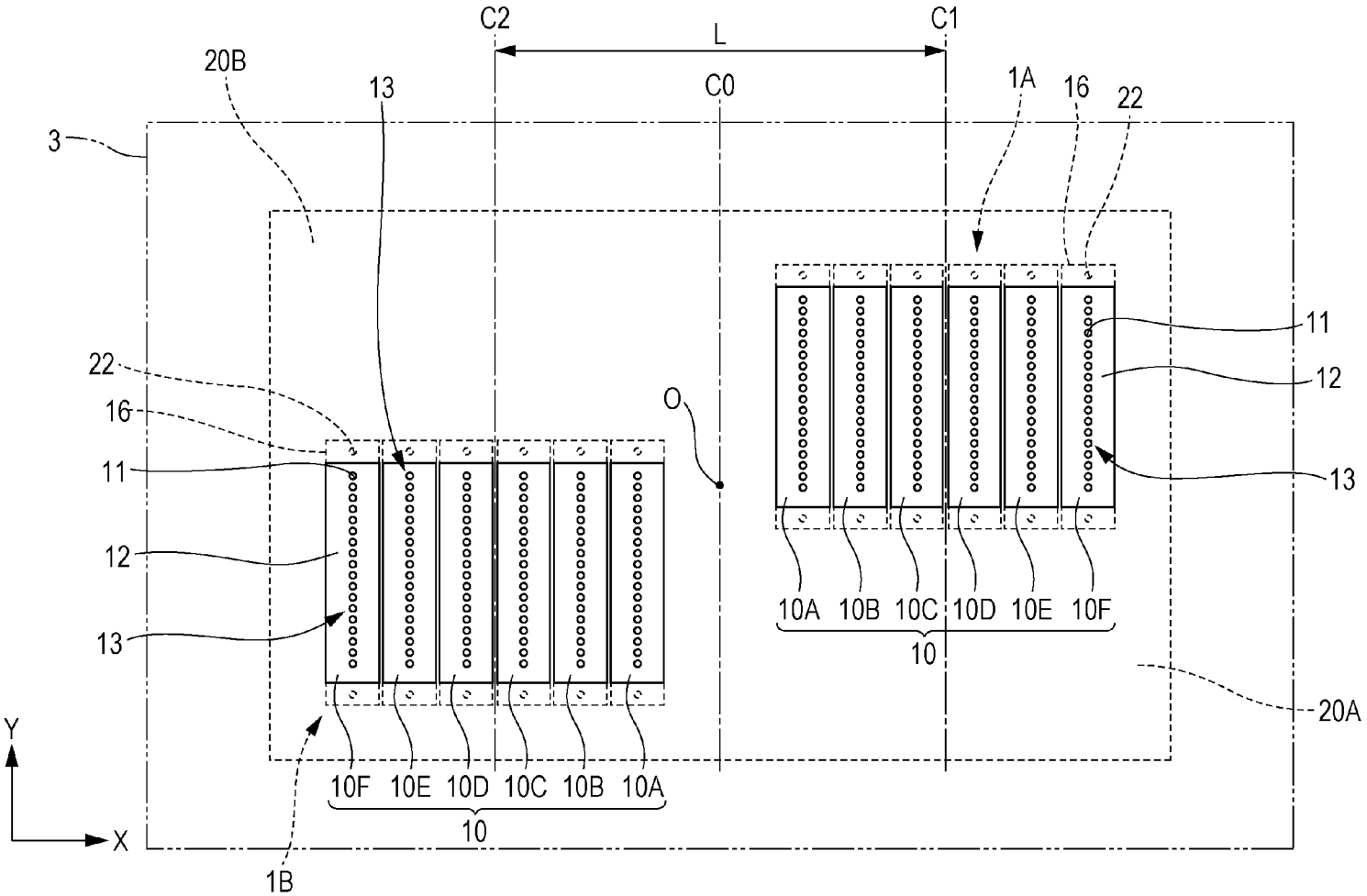
FIG. 5 is a planar view of the head units according to the first embodiment of the invention.

Next, a detailed description will be given of the head units 1A and 1B mounted on such an ink jet recording apparatus I. Here, FIG. 2 is an outline perspective view showing a recording head according to the embodiment, FIG. 3 is a planar view of the recording head on a side of a liquid ejecting surface, FIG. 4 is an outline perspective view of head units, and FIG. 5 is a planar view of the head units on the side of the liquid ejecting surface.

Figure 2:
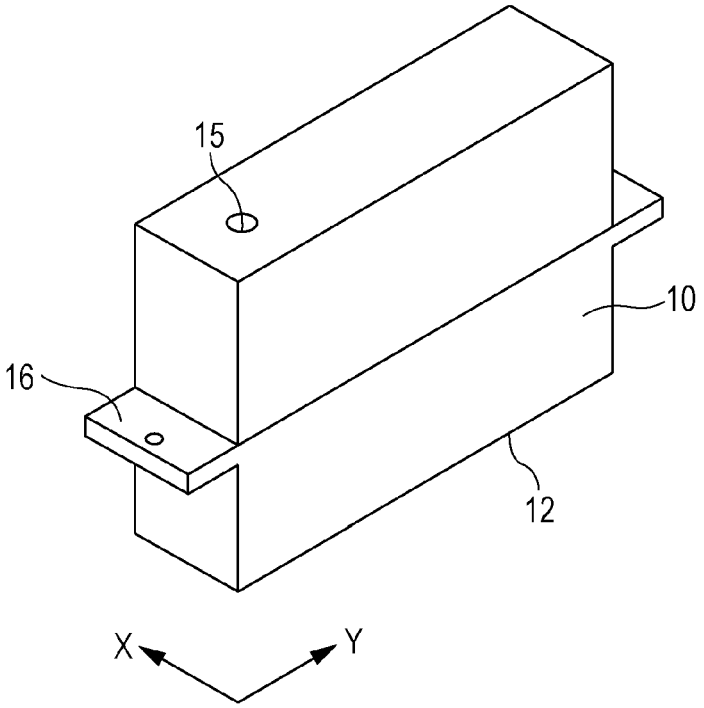
FIG. 2 is an outline perspective view of a recording head according to the first embodiment of the invention.
Figure 3:
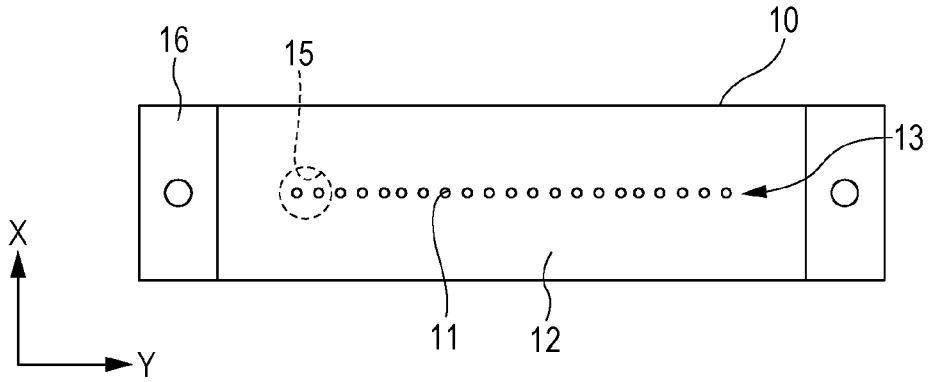
FIG. 3 is a planar view of the recording head according to the first embodiment of the invention.

As shown in FIGS. 2 and 3, each recording head 10 includes a liquid ejecting surface 12, in which nozzle openings 11 for discharging ink droplets as liquid are opened, provided on one surface. According to this embodiment, the nozzle openings 11 are provided in the sub scanning direction Y.

Inside the recording head 10, which is not shown in the drawing, a flow path which communicates with the nozzle openings 11 and a pressure generating section or the like which causes a pressure change in the ink in the flow path are provided. As such a pressure generating section, it is possible to use a configuration of causing the nozzle openings to discharge the ink droplets by changing the volume of the liquid flow path by deformation of a piezoelectric actuator configured of a piezoelectric material with an electromechanical converting function and causing a pressure change in the ink inside the liquid flow path, a configuration of causing the nozzle openings to discharge the ink droplets by bubbles generated by heat generation of a heat generation element arranged in the flow path, a so-called electrostatic actuator which causes the nozzle openings to discharge the ink droplets by generating electrostatic force between a vibration plate and an electrode and deforming the vibration plate by the electrostatic force, or the like.

Furthermore, an ink introduction port 15 which communicates with a nozzle array 13 is provided on a side of a surface opposite to the liquid ejecting surface 12 of the recording head 10. As described above, the ink introduced from the ink introduction port 15 is appropriately discharged from the respective nozzle openings 11 in the nozzle array 13 via the internal flow path which is not shown in the drawing. For this reason, the retaining section 100 which retains ink to be supplied is connected to the ink introduction port 15 with a tube 101 so as to supply the ink to be discharged to the ink introduction port 15 in order to cause the nozzle openings 11 in the nozzle array 13 to discharge specific ink such as specific color ink or specific functional ink.

In addition, a pair of flange portions 16 which protrude outward from sides of the opposite ends in the sub scanning direction Y are provided at the recording head 10.

According to the recording head 10 with such a configuration, as shown in FIGS. 4 and 5, it is possible to hold M (M is a natural number which is equal to or greater than 2) recording heads 10, namely 6 (M=6) recording heads 10 in this embodiment in a plurality of (two in FIGS. 4 and 5) holding members 20A and 20B so as to be aligned in the main scanning direction X in a state where the nozzle openings 11 are relatively positioned.

The holding members 20A and 20B are common members with the same shape, are frame bodies, in each of which a plurality of recording heads 10 capable of discharging the ink, namely six recording heads 10 in this embodiment are commonly held, and are configured of a plate-shaped member made of metal, resin, or the like provided with holding holes 21A and 21B, through each of which the six recording heads 10 are inserted.

A width of the holding holes 21A and 21B of the holding members 20A and 20B in the sub scanning direction Y is wider than the width of the tip end of the recording head 10 on the side of the liquid ejecting surface 12 and is slightly narrower than the width of the flange portions 16. In relation to a width of the holding holes 21A and 21B in the main scanning direction X, each of the holding holes 21A and 21B is an opening which is slightly wider than a total width of six recording heads 10 in the main scanning direction X according to this embodiment. With such a configuration, the six recording heads 10 on the side of the liquid ejecting surface 12 are inserted into each of the holding holes 21A and 21B in the holding members 20A and 20B. In addition, the recording heads 10 which are inserted into the holding holes 21A and 21B on the sides of the nozzle openings 11 are fixed with fixing sections 22 such as screws at the flange portions 16 in contact with circumferential edge portions of the holding holes 21A and 21B. As described above, the six recording heads 10 fixed to one holding member 20 are fixed in a state where the positions of the nozzle openings 11 correspond to each other.

Each of the head units 1A and 1B is configured as an assembly of M (M=6 in this embodiment) recording heads 10 which are integrally disposed in each of the holding members 20A and 20B, and is aligned on the carriage 3 such that center lines C1 and C2 thereof in the main scanning direction X differ from each other (such that the center lines C1 and C2 separate from each other by a distance L). Here, it is possible to attach M (M=6 in this embodiment) recording heads 10 to each of the holding members 20A and 20B in the head units 1A and 1B, and N (M>N (N is a natural number)) recording heads 10, which are made to discharge ink, among the M recording heads 10 are arranged so as to be close to the side of a center line CO of the entire width of the head units 1A and 1B in the main scanning direction X. That is, when the recording heads 10 in each of the head units 1A and 1B are referred to 10A, 10B, 10C, 10D, 10E, and 10F in an order from the side of the center line CO to the outside, the recording heads 10A to 10D which are made to discharge ink with the colors of cyan (C), magenta (M), yellow (Y), and black (B) are arranged so as to be close to the side of the center line CO. That is, N=4 in this embodiment. In contrast, (M−N=2) recording heads 10E and 10F are not made to discharge ink. Alternatively, the (M−N=2) recording heads 10E and 10F may be made to eject colorless functional ink, for example. Furthermore, the recording heads 10E and 10F, for example, which are not made to discharge ink may be detached from the holding members 20A and 20B.

Here, a combination of the recording heads 10 in the respective head units 1A and 1B can be arbitrarily changed in accordance with a use purpose. That is, it is also possible to include the recording heads 10E and 10F which discharge light cyan (LC) and light magenta (LM) in the combination of the discharge heads, or to remove one or more from the recording heads 10A to 10D which are made to discharge the ink with the colors, namely cyan (C), magenta (M), yellow (Y), and black (B). In addition, the recording heads 10A to 10F which discharge the ink with the respective colors are aligned in an arbitrary order in the main scanning direction X. For example, it is possible to consider a case where the recording heads are aligned in an order of black (B), yellow (Y), magenta (M), and cyan (C) from the center line CO to the opposite outer sides along the main scanning direction X. In such a case, the head units 1A and 1B are point-symmetrical with respect to a center O of the center line CO, and the head units 1A and 1B with the same configuration may be disposed on the carriage 3 so as to be point-symmetrical with respect to each other.

Here, the head units 1A and 1B according to this embodiment are arranged in a staggered layout with a deviation in the sub scanning direction Y. Although it is not necessary to employ such arrangement, it is possible to extend the arrangement of the nozzle openings 11 in the sub scanning direction Y by employing the staggered layout and to realize wide-band printing.

Furthermore, although the head units 1A and 1B are disposed such that adjacent nozzle openings 11 are overlapped in the main scanning direction X, it is not always necessary to employ the configuration of the overlapping arrangement. The arrangement may be adjusted in accordance with a width of a printing band. In contrast, it is also possible to provide the recording heads 10 in multiple arrays in the main scanning direction X by disposing the recording heads 10 in the head units 1A and 1B so as to overlap with each other in the sub scanning direction Y. However, it is arbitrarily determined whether to dispose the recording heads 10 in the head units 1A and 1B so as to overlap with each other in the sub scanning direction Y or the main scanning direction X.

According to this embodiment, it is possible to easily change the combination of the recording heads 10 to be disposed in the holding members 20A and 20B as described above and thereby not only to share components in multiple types of liquid ejecting apparatuses I in accordance with use purposes but to arbitrarily realize appropriate arrangement in consideration of print throughput. That is, since the recording heads 10A to 10D which are made to discharge the ink droplets and perform actual printing or the like are arranged so as to be close to the center side of the entire width of the head units 1A and 1B in the main scanning direction X, it is possible to minimize the moving amounts of the integrally moving head units 1A and 1B in the main scanning direction X.

Other Embodiments

Although the above description was given of an embodiment of the invention, a basic configuration of the invention is not limited to the aforementioned configuration. For example, although the two head units 1A and 1B are provided in the aforementioned embodiment, it is a matter of course that the number thereof is not limited to two as long as the number is equal to or more than two. A case where three or more head units are provided is also within the scope of the invention, of course, and it is possible to achieve the same operations and effects as those in the aforementioned embodiment especially when the three or more head units are arranged in the staggered layout. Furthermore, a plurality of pairs of the holding members 20A and 20B, in each of which a predetermined number of recording heads 10 are disposed, may be disposed in the sub scanning direction.

Although the aforementioned embodiment was described by employing the ink jet recording apparatus as an example of the liquid ejecting apparatus, the present invention is widely targeted to all liquid ejecting head units and liquid ejecting apparatuses provided with liquid ejecting heads, and it is a matter of course that the invention can be applied to liquid ejecting head units and liquid ejecting apparatuses provided with liquid ejecting heads for ejecting liquid other than ink. Examples of other liquid ejecting heads include various recording heads used in image recording apparatuses such as a printer, a colorant ejecting head used for manufacturing color filters such as a liquid crystal display, an electrode material ejecting head used for forming electrodes of an organic EL display, a field emission display (FED), or the like, and a bioorganic material ejecting head used for manufacturing biological chips, and the invention can be applied to liquid ejecting head units and liquid ejecting apparatuses provided with such liquid ejecting heads.

What is claimed is:

1. A liquid ejecting apparatus comprising:

a plurality of head units, each comprising a holding member as a frame having M (M is natural number) positions to which M liquid ejecting heads are attachable so as to be aligned in a main scanning direction, a plurality of nozzle openings for discharging liquid being disposed in a sub scanning direction in each of the liquid ejecting heads, wherein the head units are aligned such that center lines thereof in the main scanning direction differ from each other in the main scanning direction, wherein N (M>N (N is a natural number)) liquid ejecting heads, are arranged in N positions of each of the head units, the N positions are closest to a center side of an entire width of the plurality of head units in the main scanning direction, and no liquid ejecting heads are arranged in (M-N) positions of each of the head units while liquid is discharged from the liquid ejecting heads arranged in the N positions.

2. The liquid ejecting apparatus according to claim 1, wherein the head units are arranged in a staggered layout with a deviation in the sub scanning direction.

3. The liquid ejecting apparatus according to claim 1, wherein the N liquid ejecting heads discharge liquid with colors including black.

4. The liquid ejecting apparatus according to claim 1, wherein the N liquid ejecting heads eject colored ink.

5. The liquid ejecting apparatus according to claim 1, wherein the head units are aligned in a point-symmetric configuration.

6. A liquid ejecting apparatus comprising:

a plurality of head units, each comprising a holding member as a frame having M (M is natural number) positions to which M liquid ejecting heads are attachable so as to be aligned in a main scanning direction, a plurality of nozzle openings for discharging liquid being disposed in a sub scanning direction in each of the liquid ejecting heads, wherein the head units are aligned such that center lines thereof in the main scanning direction differ from each other in the main scanning direction, wherein N (M>N (N is a natural number)) liquid ejecting heads, are arranged in N positions of a head unit, the N positions are closest to a center side of an entire width of the plurality of head units in the main scanning direction, and a number of the liquid ejecting heads arranged in the head unit is equal to N while liquid is discharged from the liquid ejecting heads arranged in the N positions.

7. The liquid ejecting apparatus according to claim 6, wherein the head units are arranged in a staggered layout with a deviation in the sub scanning direction.

8. The liquid ejecting apparatus according to claim 6, wherein the N liquid ejecting heads discharge liquid with colors including black.

9. The liquid ejecting apparatus according to claim 6, wherein the N liquid ejecting heads eject colored ink.

* * * * *